US012422164B2

(12) United States Patent
Song

(10) Patent No.: US 12,422,164 B2
(45) Date of Patent: Sep. 23, 2025

(54) AIR CONDITIONER

(71) Applicant: SAMSUNG ELECTRONICS CO., LTD., Suwon-si (KR)

(72) Inventor: Wooseog Song, Suwon-si (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 230 days.

(21) Appl. No.: 18/127,863

(22) Filed: Mar. 29, 2023

(65) Prior Publication Data

US 2023/0258363 A1 Aug. 17, 2023

Related U.S. Application Data

(63) Continuation of application No. PCT/KR2021/014650, filed on Oct. 20, 2021.

(30) Foreign Application Priority Data

Dec. 17, 2020 (KR) ..... 10-2020-0177899

(51) Int. Cl.
*F24F 13/08* (2006.01)
*F24F 8/80* (2021.01)
*F24F 110/64* (2018.01)

(52) U.S. Cl.
CPC ..... *F24F 13/082* (2013.01); *F24F 8/80* (2021.01); *F24F 2110/64* (2018.01)

(58) Field of Classification Search
CPC ..... F24F 13/082; F24F 13/20; F24F 2110/64; F24F 2110/50; F24F 2110/65; F24F 8/80; F24F 2013/205; F24F 11/89
See application file for complete search history.

(56) References Cited

U.S. PATENT DOCUMENTS 8,365,578 B2 2/2013 Bae
D967,377 S * 10/2022 Jo ..... D23/364
(Continued)

FOREIGN PATENT DOCUMENTS

JP 8-33822 2/1996
JP 2015-124914 7/2015
(Continued)

OTHER PUBLICATIONS

International Search Report issued in International Application No. PCT/KR2021/014650 dated Feb. 15, 2022.
(Continued)

*Primary Examiner* — Nelson J Nieves
(74) *Attorney, Agent, or Firm* — STAAS & HALSEY LLP

(57) ABSTRACT

An air conditioner comprising a main body comprising an inlet; a plurality of guide flow paths to guide air from outside of the main body to the inlet of the main body; a fan to guide the air inside of the main body through the inlet; an air current separation surface, arranged between adjacent guide flow paths among the plurality of guide flow paths, to allow the air from outside of the main body to be separated and flow to the plurality of guide flow paths; a sensor; and a sensor connection port arranged adjacent to and facing the air current separation surface so that while the sensor is connected to the sensor connection port, an air current to be sensed flows to the sensor through the sensor connection port as the air separated by the air current separation surface flows toward the plurality of guide flow paths.

15 Claims, 9 Drawing Sheets

(56) References Cited

U.S. PATENT DOCUMENTS

| | | | | |
|---|---|---|---|---|
| 11,525,588 | B2 | 12/2022 | Kim et al. | |
| 12,055,305 | B2 * | 8/2024 | Yoon | F04D 29/703 |
| 2010/0175399 | A1 * | 7/2010 | Choi | F24F 13/20 62/186 |
| 2011/0312263 | A1 * | 12/2011 | Grandmaison | F24F 13/14 454/283 |
| 2015/0224437 | A1 * | 8/2015 | Nygren | F24F 11/30 95/1 |
| 2019/0232210 | A1 * | 8/2019 | Hur | B01D 46/442 |
| 2019/0301761 | A1 | 10/2019 | Scheja et al. | |
| 2020/0326090 | A1 * | 10/2020 | Chu | F24F 11/65 |
| 2020/0386423 | A1 * | 12/2020 | Chu | F24F 8/80 |
| 2021/0063026 | A1 * | 3/2021 | Kim | F24F 13/28 |
| 2021/0080146 | A1 * | 3/2021 | Henderson | F24F 11/89 |
| 2022/0090801 | A1 * | 3/2022 | Zeng | F24F 8/192 |
| 2023/0102091 | A1 * | 3/2023 | Kim | F04D 29/602 55/357 |
| 2023/0151958 | A1 * | 5/2023 | Okagaki | F21V 33/0092 |

FOREIGN PATENT DOCUMENTS

| | | | | |
|---|---|---|---|---|
| JP | 2017032253 A * | 2/2017 | | F24F 13/20 |
| JP | 6177734 | 8/2017 | | |
| KR | 10-0360427 | 11/2002 | | |
| KR | 10-2005-0087231 | 8/2005 | | |
| KR | 20100010280 A * | 7/2008 | | B01D 46/44 |
| KR | 10-2010-0010280 | 2/2010 | | |
| KR | 10-1003583 | 12/2010 | | |
| KR | 10-1006820 | 1/2011 | | |
| KR | 10-1158594 | 7/2012 | | |
| KR | 10-2014-0077494 | 6/2014 | | |
| KR | 10-1631220 | 6/2016 | | |
| KR | 10-2017-0083793 | 7/2017 | | |
| KR | 10-2018-0010747 | 1/2018 | | |
| KR | 10-2018-0084415 | 7/2018 | | |
| KR | 10-2019-0007135 | 1/2019 | | |
| KR | 10-2019-0029480 | 3/2019 | | |
| KR | 10-2019-0072368 | 6/2019 | | |
| KR | 10-2020-0090345 | 7/2020 | | |

OTHER PUBLICATIONS

Written Opinion issued in International Application No. PCT/KR2021/014650 dated Feb. 15, 2022.

Extended European Search Report dated Mar. 6, 2024 for corresponding European application No. 21906821.0.

Korean Office Action dated May 1, 2025 for Korean Application No. 10-2020-0177899.

* cited by examiner

AIR CONDITIONER

CROSS-REFERENCE TO RELATED APPLICATION

This application is a continuation application, under 35 U.S.C. § 111(a), of international application No. PCT/KR2021/014650, filed on Oct. 20, 2021, which claims priority under 35 U. S. C. § 119 to Korean Patent Application No. 10-2020-0177899, filed Dec. 17, 2020, the disclosures of which are incorporated herein by reference in their entirety.

BACKGROUND

Field

The present disclosure relates to an air conditioner, and more particularly, to an air conditioner including an improved air current guide structure for measuring a level of contamination in a space to be purified.

Discussion of Related Art

An air conditioner is a device that sucks indoor air and conditions the sucked air and then sends the conditioned air out. At this time, air conditioning refers to appropriately adjusting the temperature and humidity, cleanliness, and airflow distribution of indoor air. Types of air conditioners may include ventilation devices, cooling and heating devices, air purifiers, humidifiers, and the like.

An air purifier, which is an example of an air conditioner, is a device used to adjust the cleanliness of indoor air by removing contaminants in the air. The air purifier may remove germs, viruses, molds, fine dust, and chemicals that cause odors in the sucked air.

The air purifier may include a filter for purifying polluted indoor air. While the air sucked into the air purifier passes through the filter, contaminants in the sucked air may be filtered out, and thus the sucked air may be purified. Accordingly, the purified air may be discharged to the outside of the air purifier.

For the purification operation of the air purifier, it is necessary to measure a level of contamination of the space to be purified. In order to measure the level of contamination of the space to be purified, a sensor such as a particle sensor may be applied to the air purifier. The particle sensor irradiates a laser beam on particles contained in the air and then measures the level of contamination based on the amount of beam scattered by the particles.

In a conventional manner, a sensor connection port connected to the sensor is formed mainly toward the side of the product. However, according to the installation environment of the air conditioner, the sensor connection port may be blocked, resulting in an error in measuring the contamination level of the space to be purified. In addition, because the pressure distribution formed around the sensor connection port is not constant, an error in measuring the contamination level of the space to be purified may occur.

SUMMARY

One aspect of the present disclosure provides an air conditioner including a main body including an inlet, a plurality of guide flow paths to guide air from outside of the main body to the inlet of the main body: a fan to guide the air guided by the plurality of guide flow paths and introduced to inside of the main body through the inlet, an air current separation surface, arranged between adjacent guide flow paths among the plurality of guide flow paths, to allow the air from outside of the main body to be separated and flow to the plurality of guide flow paths, a sensor to sense a level of contamination in an indoor space, and a sensor connection port arranged adjacent to and facing the air current separation surface so that while the sensor is connected to the sensor connection port, an air current to be sensed flows to the sensor through the sensor connection port as the air separated by the air current separation surface flows toward the plurality of guide flow paths.

The air conditioner may further include an inlet panel to form an exterior of the main body and to cover the inlet, the inlet panel to allow the air from the outside of the main body to flow toward the inlet.

The plurality of guide flow paths and the air current separation surface may be formed on the inlet panel.

The inlet panel may include a guide grille to cover the inlet, and a guide flange formed along a circumference of the guide grille and coupleable to the main body. The plurality of guide flow paths and the air current separation surface may be formed on the guide flange.

The plurality of guide flow paths may be provided in a shape that extends along a circumference of the guide flange.

The air current separation surface may be provided to form a part of a surface of the inlet panel.

The air current separation surface may be among a plurality of air current separation surfaces. The sensor connection port and the sensor that is connectable to the sensor connection port may be provided to correspond to at least one air current separation surface of the plurality of air current separation surfaces.

The guide flange may be provided in such a way that a cross section formed by the circumference of the guide flange becomes smaller from the guide grille toward the main body.

The air current separation surface may be formed as a convex curved surface.

The air current separation surface may include a guide groove concavely recessed at a position corresponding to the sensor connection port. A flow of air introduced through the guide groove may be transferred to the sensor by passing through the sensor connection port.

The main body may be formed as a polyhedron. The inlet may correspond to one surface of the main body. The guide flange may correspond to an edge of the one surface to which the inlet corresponds.

The edge may be among a plurality of edges. Each of the plurality of guide flow paths may be formed to correspond to each of the plurality of edges. The air current separation surface may correspond to a corner to which adjacent edges among the plurality of edges are connected.

A cross-sectional area of the plurality of guide flow paths is formed on the inlet panel may be greater than an area of the sensor connection port.

The air current separation surface may be provided on one side of an upper end of the inlet.

The air conditioner may further include a sensor case arranged inside the main body and provided to accommodate the sensor. The sensor case may include a sensor flow path in which the sensor connection port is formed.

The air conditioner may further include a guard flange arranged between the inlet panel and the main body, and spaced from an outer circumference of the guide flange. The guard flange may be formed in a shape corresponding to the guide flange to fix the inlet panel and the main body to each other. The guard flange may include an auxiliary flow path provided in a shape corresponding to the sensor connection port and arranged at a position corresponding to the sensor connection port.

BRIEF DESCRIPTION OF THE DRAWINGS

The above and other objects, features and advantages of the present disclosure will become more apparent to those of ordinary skill in the art by describing in detail exemplary embodiments thereof with reference to the accompanying drawings, in which.

DETAILED DESCRIPTION OF EXEMPLARY EMBODIMENTS

Figure 1:
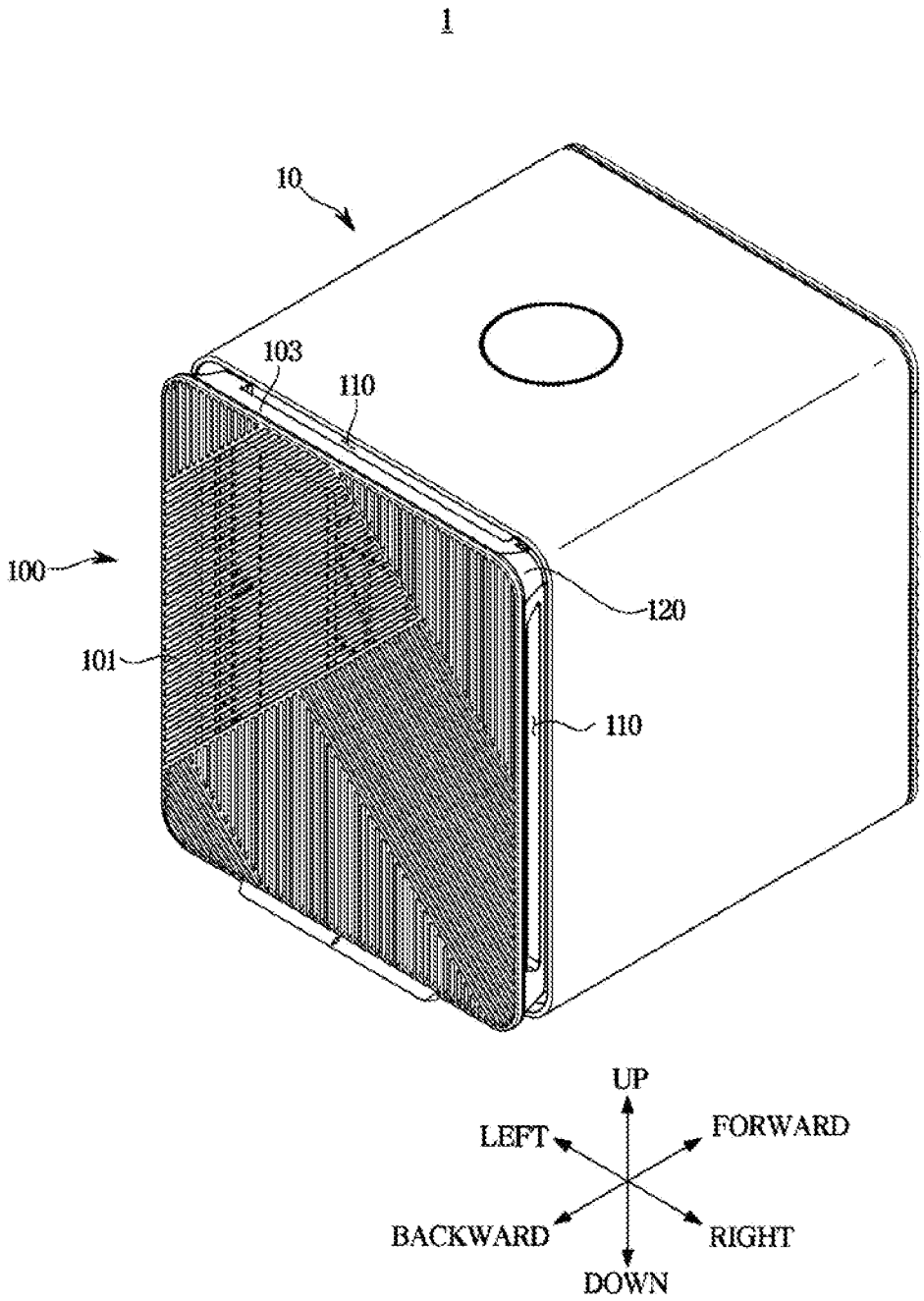
FIG. 1 is a perspective view of an air conditioner according to one embodiment of the present disclosure.

Embodiments described in the disclosure and configurations shown in the drawings are merely examples of the embodiments of the disclosure, and may be modified in various different ways at the time of filing of the present application to replace the embodiments and drawings of the disclosure.

In addition, the same reference numerals or signs shown in the drawings of the disclosure indicate elements or components performing substantially the same function.

Also, the terms used herein are used to describe the embodiments and are not intended to limit and/or restrict the disclosure. The singular forms "a," "an" and "the" are intended to include the plural forms as well, unless the context clearly indicates otherwise. In this disclosure, the terms "including", "having", and the like are used to specify features, numbers, steps, operations, elements, components, or combinations thereof, but do not preclude the presence or addition of one or more of the features, elements, steps, operations, elements, components, or combinations thereof.

It will be understood that, although the terms first, second, third, etc., may be used herein to describe various elements, but elements are not limited by these terms. These terms are only used to distinguish one element from another element. For example, without departing from the scope of the disclosure, a first element may be termed as a second element, and a second element may be termed as a first element. The term of "and/or" includes a plurality of combinations of relevant items or any one item among a plurality of relevant items.

On the other hand, the terms "forward", "backward", "left" and "right" used in the following description are defined based on FIG. 1, and the shape and position of each component are not limited by these terms. Referring to the coordinate axes shown in the drawings, the X-axis represents the front and rear direction, the Y-axis represents the left and right direction, and the Z-axis represents the up and down direction. Meanwhile, a direction parallel to the XY plane, such as the front and rear direction or the left and right direction, may be referred to as a horizontal direction. It is said to be horizontal when it is parallel to the XY plane. A direction perpendicular to the XY plane may be referred to as a vertical direction.

In addition, although an air purifier, which is a type of air conditioner, will be described as an example for convenience of description, the configuration of the present disclosure is not limited to the air purifier and may be applied to the air conditioner. For example, it may also be applied to other types of air conditioners such as a cooling and heating device. Further, it may be applied to any home appliance as long as the home appliance includes a fan and a flow path through which air is sucked and discharged by the fan to blow air to the outside.

The present disclosure is directed to providing an air conditioner capable of measuring a level of contamination of a space to be purified without being affected by a main air current inside the air conditioner formed by a fan and a main air current outside the air conditioner, and installation environment.

By using a plurality of guide flow paths connected to an inlet of a main body, an air current separation surface arranged between the guide flow paths, and a sensor connection port arranged to face the air current separation surface, an air conditioner may measure a level of contamination in a space to be purified without being affected by a main air current inside and outside the air conditioner and installation environment.

The disclosure will be described more fully hereinafter with reference to the accompanying drawings.

Figure 2:
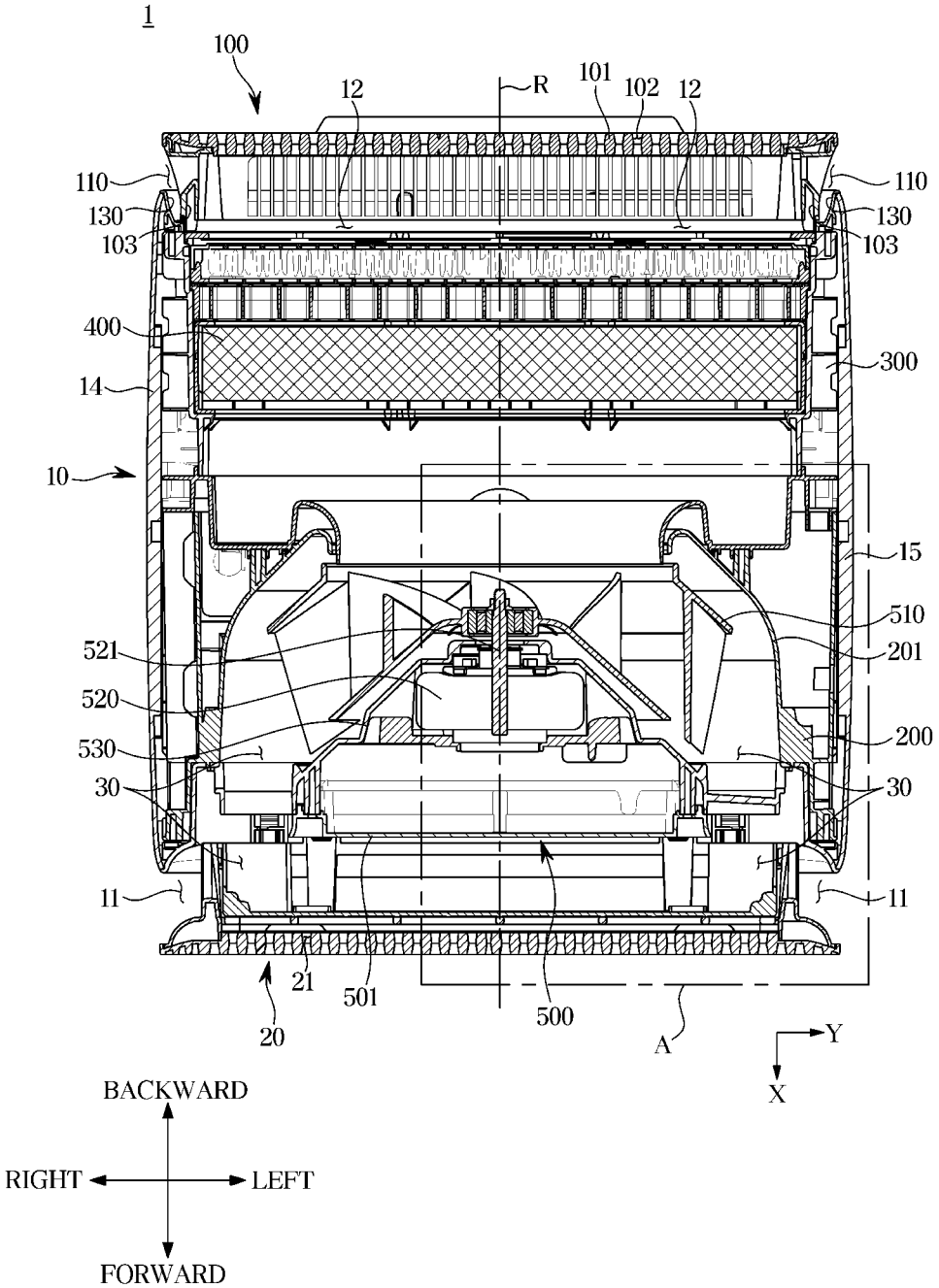
FIG. 2 is a cross-sectional view of the air conditioner shown in FIG. 1 according to an embodiment of the disclosure.
Figure 3:
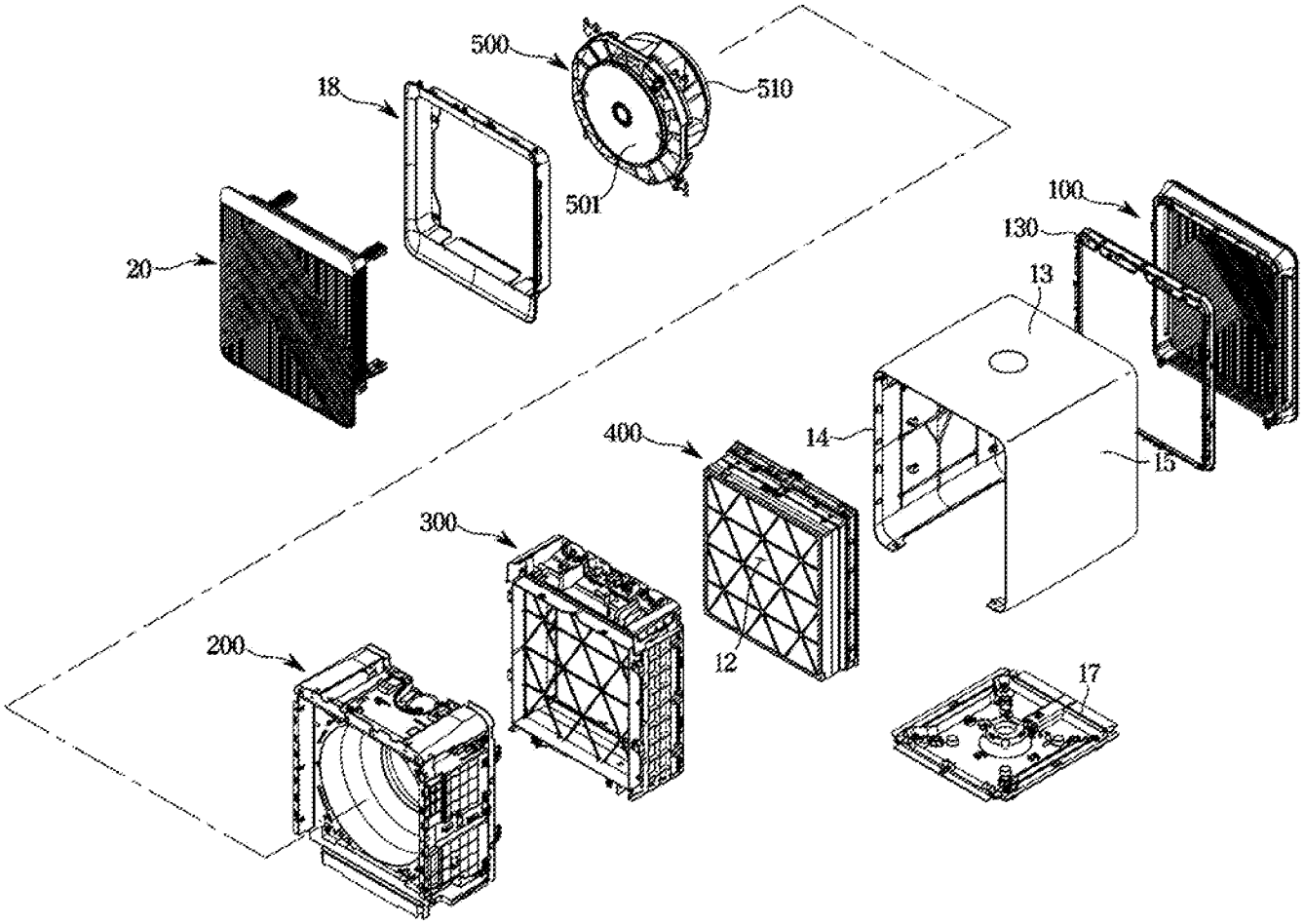
FIG. 3 is an exploded perspective view of the air conditioner shown in FIG. 1 according to an embodiment of the disclosure.

FIG. 1 is a perspective view of an air conditioner according to one embodiment of the present disclosure. FIG. 2 is a cross-sectional view of the air conditioner shown in FIG. 1. FIG. 3 is an exploded perspective view of the air conditioner shown in FIG. 1.

Referring to FIGS. 1 to 3, an air conditioner 1 may include a main body 10 formed in a rectangular parallelepiped or a regular hexahedron. However, the shape of the main body 10 of the air purifier 1 is not limited to a rectangular parallelepiped or a regular hexahedron, and may be provided in various shapes such as a polyhedron or a cylinder.

The main body 10 may include a cabinet forming an exterior. The cabinet may include an upper cabinet 13, a left cabinet 14, a right cabinet 15, and a lower cabinet 17. The main body 10 may include an edge panel 18 forming a rim of the front surface of the open main body 10.

The upper cabinet 13, the left cabinet 14, and the right cabinet 15 may be integrally formed. The upper cabinet 13, the left cabinet 14, the right cabinet 15, and the lower cabinet 17 may sequentially form upper, left, right and lower surfaces of the main body 10. An inlet panel 100 may form a rear surface of the main body 10.

The air conditioner 1 may include an inlet 12 formed in the main body 10 to allow outside air, which is distributed in the outside of the air conditioner 1, to flow to the inside of the air conditioner, particularly, the inside of the main body 10, and an outlet 11 formed in the main body 10 to allow the air, which is introduced through the inlet 12, to be discharged. The inlet 11 and the outlet 12 may be formed on different surfaces or on the same surface. The inlet 12 may be formed on a rear side of the main body 10. The outlet 11 may be formed on a front side of the main body 10.

The main body 10 of the air conditioner 1 may be formed as a polyhedron, and the inlet 12 may correspond to one surface of the polyhedron. The main body 10 of the air conditioner 1 according to the present disclosure may be provided in a rectangular parallelepiped or a regular hexahedron, and the inlet 12 may correspond to a rear surface of the rectangular parallelepiped or the regular hexahedron. Accordingly, the inlet 12 may have a substantially rectangular shape. However, the shape of the inlet 12 is not limited thereto.

The 'inlet' may roughly refer to various openings provided to allow the outside of the air conditioner 1 to communicate with the inside of the main body 10 of the air conditioner 1. For example, a gap between guide grilles 101 or a guide flow path 110, which will be described later, may be regarded as an inlet in a broad sense. However, the inlet 12 according to one embodiment of the present disclosure refers to an opening that is formed on one side of the main body 10 and opened toward the outside of the air conditioner 1 in a state in which the inlet panel 100 is separated from the main body 10.

The air conditioner 1 may further include a filter unit 400 and a fan assembly 500 arranged inside the main body 10. The fan assembly 500 may suck the air outside the air conditioner 1 into the main body 10 through the inlet 12 and allow the sucked air to pass through the filter unit 400, and discharge the air filtered by the filter unit 400 to the outside of the main body 10 through the outlet 11. The filter unit 400 may purify the air sucked through the inlet 12 and may be detachably installed in the main body 10.

The air conditioner 1 may further include a filter case 300 to which the filter unit 400 is mounted. The air conditioner 1 may further include a fan case 200 in which the fan assembly 500 is accommodated and fixed.

The fan case 200 may include an inner wall 201 forming a blowing flow path 30 provided to guide an air current formed by the fan assembly 500 to the outlet 11 arranged in the front of the fan case 200. A fan 510 may be covered by the inner wall 201. The filter case 300 may be arranged behind the fan case 200. The filter case 300 and the fan case 200 may be covered by the cabinet. Meanwhile, the blowing flow path 30 may represent a flow path in which air moved by the fan assembly 500 flows from the inlet 12 of the air conditioner 1 to the outlet 11 or a micro discharge port 21 of the air conditioner 1.

The fan assembly 500 may include the fan 510 configured to generate an air current inside the main body 10, a motor 520 configured to drive the fan 510, and a motor cover 501 in which the motor 520 is accommodated and fixed.

The motor 520 may include a shaft 521, and the shaft 521 may be coupled to the fan 510 to transmit power of the motor 520 to the fan 510. The shaft 521 may extend in the front and rear direction.

The fan 510 may have a rotation axis R parallel to the front and rear direction. The fan 510 may include a mixed flow fan. The fan 510 may include a turbofan. The fan 510 may include a suction port 111 provided to suck air from the rear side. The fan 510 may include a plurality of blades 112. The fan 510 may discharge air forward.

The motor cover 501 may support the fan 510 to allow the fan 510 to be arranged inside the fan case 200. Particularly, as the motor cover 501, to which the motor 520 to which the fan 510 is coupled is fixed, is fixed to the fan case 200, the fan 510 may be supported by the motor cover 501.

The motor cover 501 may include a cover bracket 530 coupled to the fan case 200.

The air conditioner 1 may include a discharge panel 20 configured to be moved with respect to the main body 10, thereby adjusting the size of the discharge port 11. The discharge panel 20 may be arranged in front of the main body 10. The discharge panel 20 may form the front surface of the exterior of the air conditioner 1.

When the discharge panel 20 moves forward by a predetermined length, the size of the discharge port 11 may be increased. When the discharge panel 20 moves forward by a predetermined length and then moves backward by a predetermined length, the size of the outlet 11 may be reduced.

In other words, the discharge port 11 may correspond to a gap between the discharge panel 20 and the main body 10. The size of the discharge port 11 may be increased as the discharge panel 20 and the main body 10 are farther away from each other. The size of the discharge port 11 may be reduced as the discharge panel 20 and the main body 10 are closer to each other. When the discharge panel 20 and the main body 10 come into contact with each other, the discharge port 11 may be closed and the air may be discharged to the outside of the air conditioner 1 through a plurality of micro discharge ports 21 formed on the discharge panel 20. Because an area of each of the plurality of micro discharge ports 21 is less than an area of the discharge port 11, the air passing through the micro discharge port 21 may be discharged at a lower speed than the air passing through the discharge port 11. Meanwhile, all or part of the blowing flow path 30 may be provided inside the main body 10. A part of the blowing flow path 30 may be provided between the main body 10 and the panel 20.

However, it is not limited thereto. The discharge panel 20 may be immovably fixed to the front of the main body 10, and the outlet 11 may be formed in the discharge panel 20 or the main body 10. The discharge panel 20 and the main body 10 may be integrally provided.

The air conditioner 1 may further include the inlet panel 100 covering the inlet 12 that is opened toward the rear.

The inlet panel 100 may form the exterior of the main body 10. The inlet panel 100 may form the rear surface of the exterior of the air conditioner 1.

The inlet panel 100 may be provided to allow the inlet 12 to communicate with the outside of the main body 10.

The inlet panel 100 may include a guide grille 101 and a guide flange 103. The guide grille 101 may form the exterior of the main body. The guide grille 101 may form the rear surface of the exterior of the air conditioner 1. The guide grille 101 may be provided to cover the open inlet 12. The guide grille 101 may be provided in a shape corresponding to the inlet 12. In the air conditioner 1 according to the present disclosure, the guide grille 101 is formed in a substantially rectangular shape in accordance with the shape of the inlet 12, but is not limited thereto. Alternatively, the guide grille 101 may be formed in various shapes. A detailed structure of the guide grille 101 will be described later.

However, it is described that the inlet panel 100 includes the guide grille 101 including a plurality of thin blades, but is not limited thereto. The guide grille 101 may be formed in a structure in which a plurality of holes is formed in a flat panel. When a user looks at the inlet panel 100 from the outside of the air conditioner 1 in a state in which the plurality of holes is provided in a predetermined pattern, the user can see the certain pattern. In addition, the inlet 12 and the outside of the main body 10 may communicate through the plurality of holes.

The inlet panel 100 may further include the guide flange 103 formed along a circumference of the guide grille 101. The guide flange 103 may protrude from the circumference of the guide grille 101 toward the inlet 12. The inlet panel 100 may be coupled to the main body 10 through a fastening structure formed on the guide flange 103. The guide flange 103 may be provided in a substantially annular shape. In the air conditioner 1 according to the present disclosure, the annular shape of the guide flange 103 may be formed in substantially rectangular shape in accordance with the shape of the inlet 12 and the guide grille 101, but is not limited thereto. The annular shape of the guide flange 103 may be formed in various shapes.

The guide flange 103 may be formed in such a way that a cross section formed by the circumference of the guide flange 103 becomes smaller from the guide grille 101 toward the main body 10. In other words, a width L (refer to FIG. 5) between parts facing each other in the guide flange 103 may be gradually reduced from the guide grille 101 toward the main body 10.

A flow path formed by the guide grille 101 and the guide flange 103 may be defined as a main flow path. The main flow path may be provided to allow the inlet 12 and the outside of the air conditioner 1 to communicate with each other. However, the structure of the main flow path is not limited to the combination of the guide grille 101 and the guide flange 103. Alternatively, the main flow path may be formed in various structures as long as the main flow path forms the exterior of the air conditioner 1 and allows the inlet 12 of the main body 10 to effectively communicate with the outside of the air conditioner 1.

The guide flange 103 may include a guide flow path 110 and an air current separation surface 120. The guide flow path 110 may include a plurality of guide flow paths 110 formed along the circumference of the main flow path. A detailed structure and function of the guide flow path 110 and the air current separation surface 120 will be described later.

The inlet panel 100 may further include a guard flange 130 arranged between the inlet panel 100 and the main body 10. The guard flange 130 may be provided to be spaced apart from an outer circumference of the guide flange 103. The guard flange 130 may be provided in a shape corresponding to the guide flange 103. The guard flange 130 may be provided in a shape surrounding a portion of the outer circumference of the guide flange 103. The guard flange 130 may further include an auxiliary flow path 131 (refer to FIG. 6) provided in a shape corresponding to a sensor connection port 150 and arranged at a position corresponding to the sensor connection port 150 so as not to disturb the flow of a sensing air current S2 described later.

The guard flange 130 may be arranged between the inlet panel 100 and the main body 10 to fix the inlet panel 100, particularly, the guide flange 103 to the main body 10. The inlet panel 100, the guard flange 130, and the main body 10 may be fixed to each other through a hook and groove, corresponding to the hook, structure. The fastening structure is not limited to the hook-and-groove structure, and may be provided in various structures such as screw fastening.

Referring to FIG. 3, the guard flange 130 may be formed in a substantially rectangular annular shape in accordance with the shape of the guide flange 103. In the air conditioner 1 according to the present disclosure, the annular shape of the guard flange 130 is formed in a substantially rectangular shape in accordance with the shape of the inlet 12 and the guide flange 103, but is not limited thereto. The annular shape of the guard flange 130 may be formed in various shapes.

Figure 4:
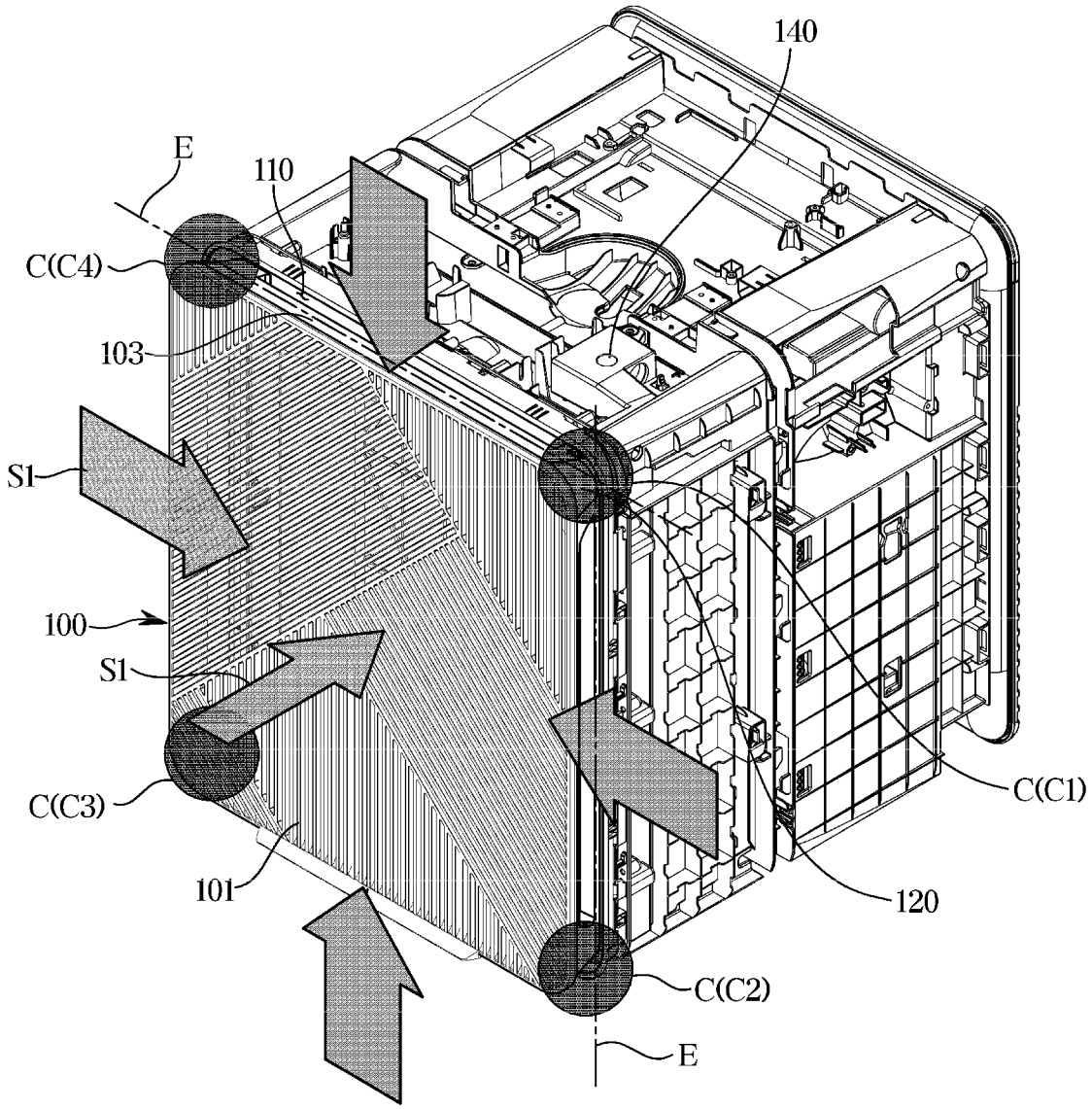
FIG. 4 is a view illustrating a flow of air introduced toward an inlet panel after a cabinet of the air conditioner shown in FIG. 1 is removed according to an embodiment of the disclosure.
Figure 5:
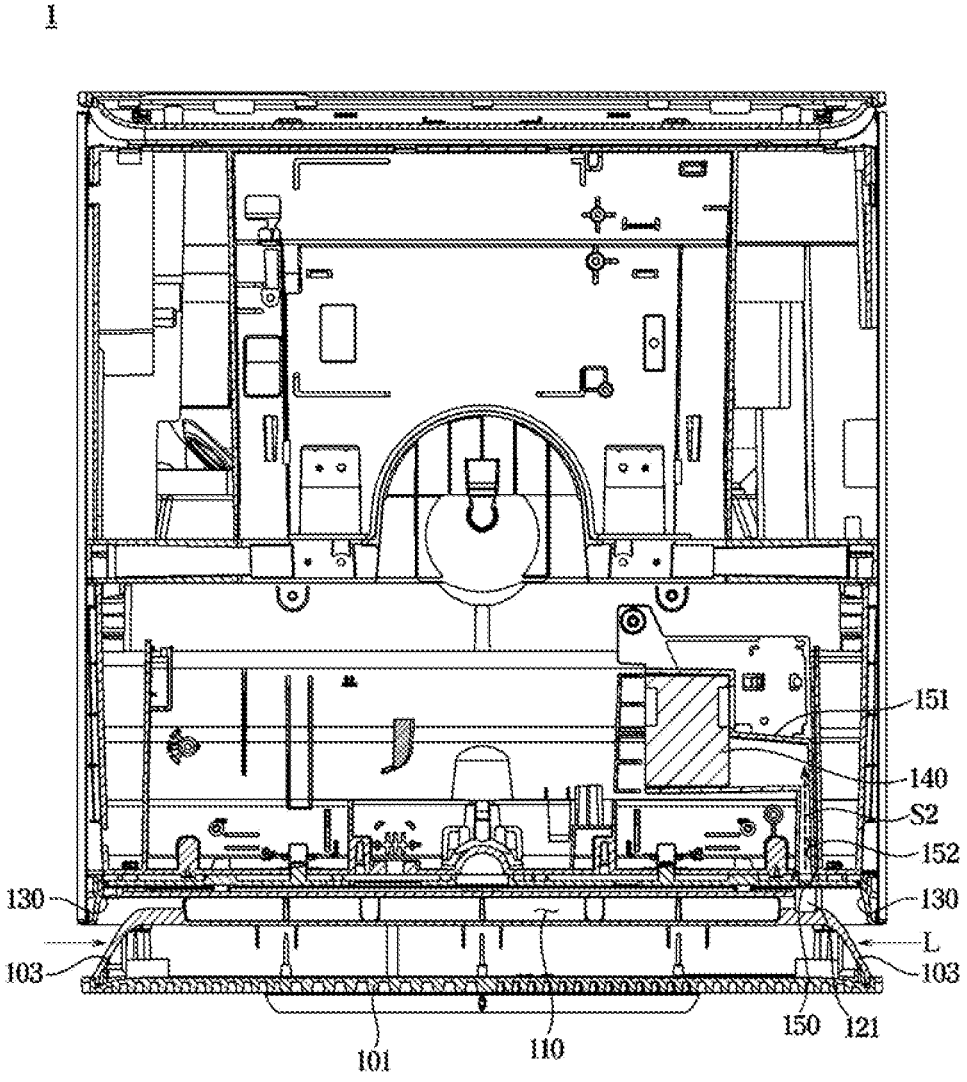
FIG. 5 is a cross-sectional view including a sensor connection port of the air conditioner shown in FIG. 1 according to an embodiment of the disclosure.
Figure 6:
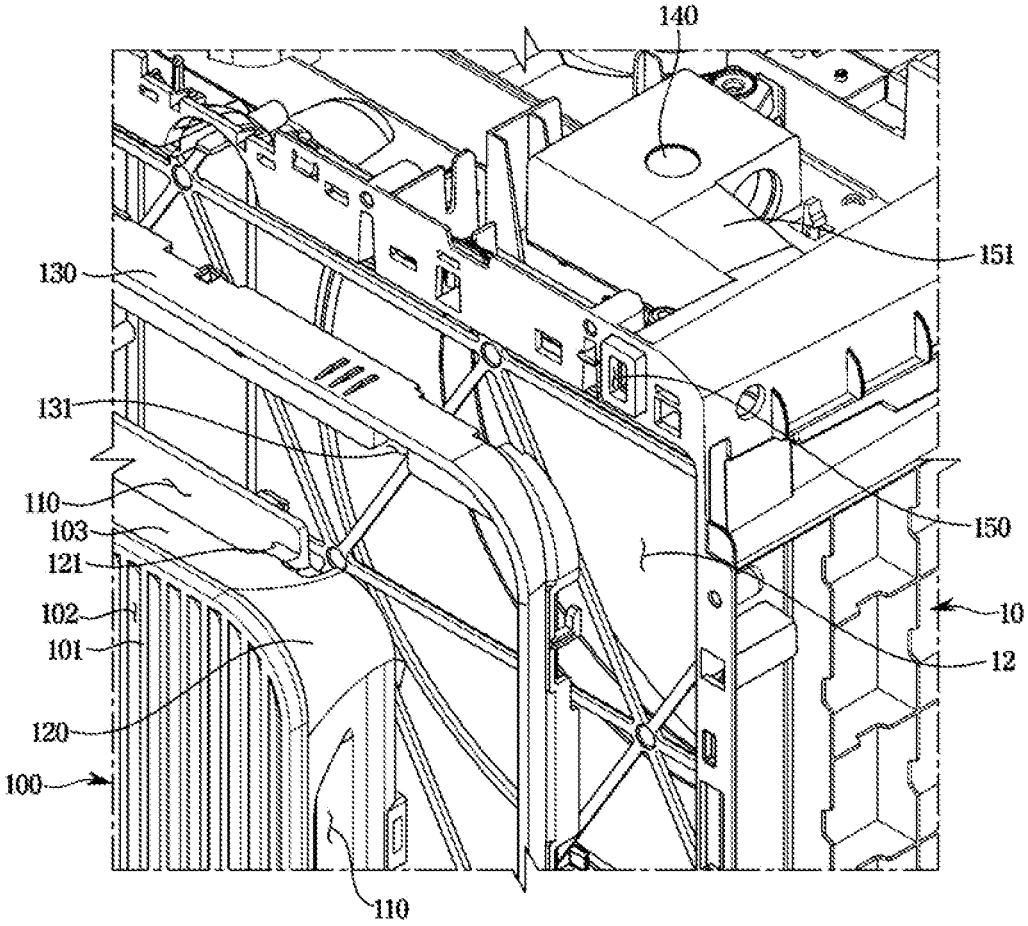
FIG. 6 is an enlarged view illustrating a state in which a main body, a guard flange and the inlet panel of FIG. 3 are separated from each other according to an embodiment of the disclosure.
Figure 7:
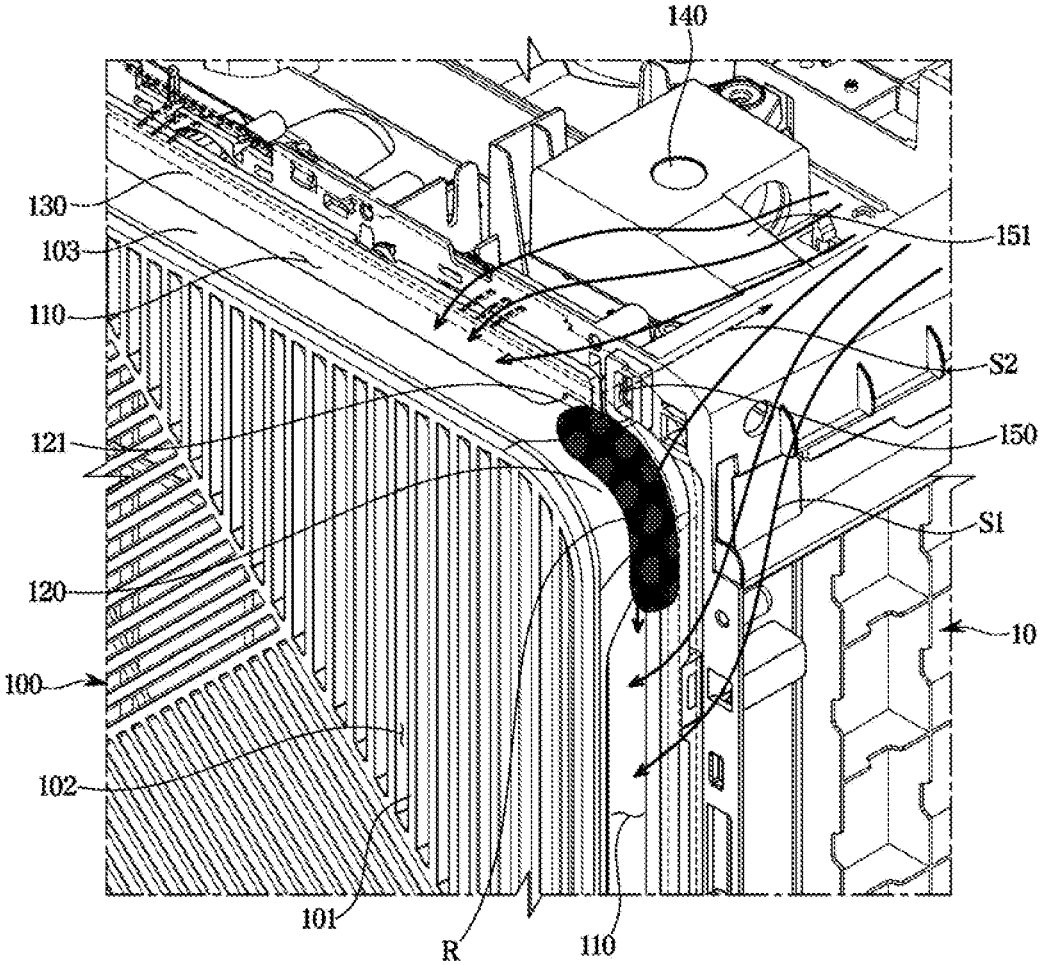
FIG. 7 is an enlarged view illustrating a state in which the main body, the guard flange and the inlet panel of FIG. 6 are coupled to each other according to an embodiment of the disclosure.
Figure 8:
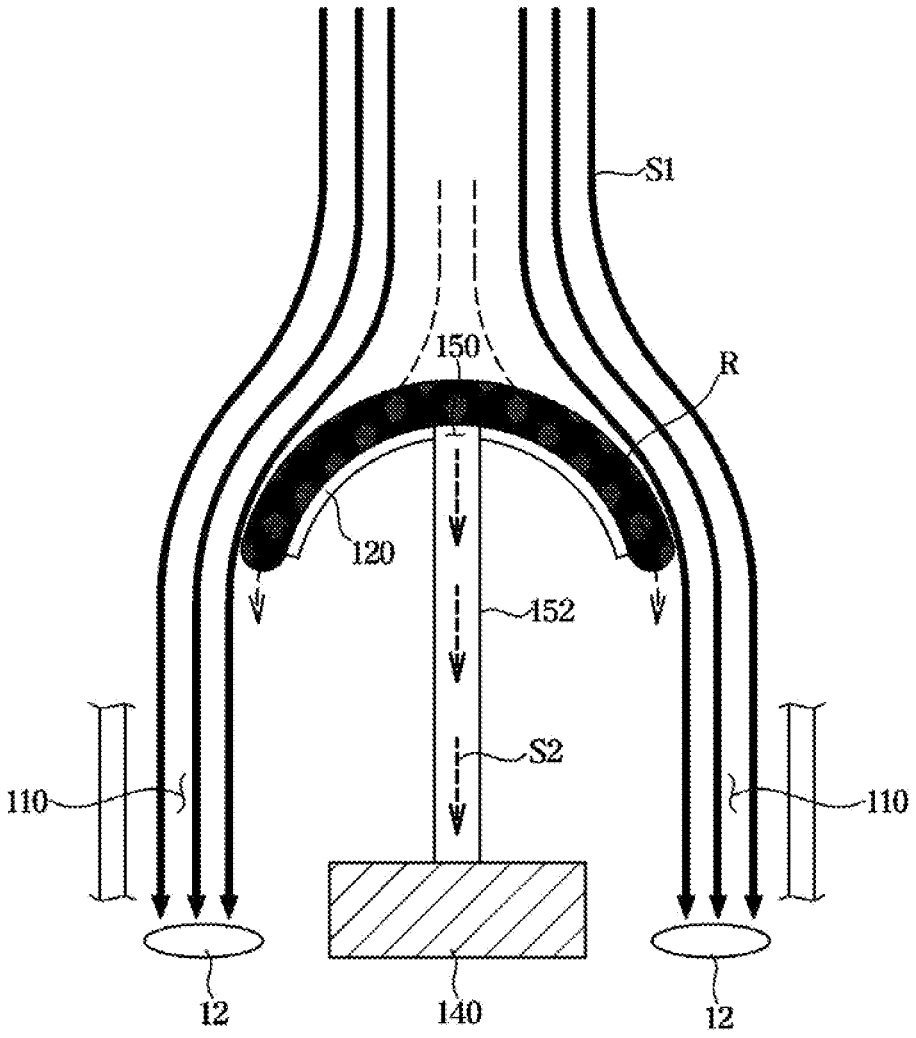
FIG. 8 is a conceptual diagram illustrating a relationship between an inlet, a guide flow path, an air current separation surface, and a sensor connection port according to an embodiment of the disclosure.

FIG. 4 is a view illustrating a flow of air introduced toward an inlet panel after a cabinet of the air conditioner shown in FIG. 1 is removed. FIG. 5 is a cross-sectional view including a sensor connection port of the air conditioner shown in FIG. 1. FIG. 6 is an enlarged view illustrating a state in which a main body, a guard flange and the inlet panel of FIG. 3 are separated from each other. FIG. 7 is an enlarged view illustrating a state in which the main body, the guard flange and the inlet panel of FIG. 6 are coupled to each other. FIG. 8 is a conceptual diagram illustrating a relationship between an inlet, a guide flow path, an air current separation surface, and a sensor connection port. The contamination level measurement result of the sensor may be changed according to a position of the sensor connection port of a sensor flow path, to which outside air is delivered, in the air conditioner.

In a conventional manner, in order to prevent a sensor connection port from being affected by a flow of air formed in a region adjacent to an inlet, the sensor connection port of a sensor flow path is formed in a side surface of a main body of an air conditioner that is spaced apart from the inlet. However, in this structure, the sensor connection port may be blocked depending on installation environment, and thus an error in measuring a contamination level of a space to be purified may occur. In addition, because the pressure distribution formed around the sensor connection port is not constant, an error in measuring the contamination level of the space to be purified may occur.

In order to measure the contamination level of the space to be purified without being affected by the main air current inside the air conditioner formed by the fan and the main air current outside of the air conditioner, and the installation environment of the air conditioner, the guide flange 103 of the inlet panel 100 may include the guide flow path 110 and the air current separation surface 120. In addition, the sensor connection port 150 connected to a sensor 140 may be arranged adjacent to the air current separation surface 120 so as to face the air current separation surface 120.

Hereinafter specific structures and functions of the guide flow path 110, the air current separation surface 120, and the sensor connection port 150 will be described.

Referring to FIGS. 4 and 5, the air conditioner 1 may further include the sensor 140 configured to measure a level of contamination of the space to be purified. The sensor 140 may be provided as a particle sensor. The particle sensor irradiates a laser beam on particles contained in the air and then measures the level of contamination based on the amount of beam scattered by the particles.

The air conditioner 1 may further include a sensor case 151 arranged inside the main body 10 and provided to receive the sensor 140. The sensor case 151 may be formed in a shape in accordance with the shape of the sensor 140 to allow the sensor 140 to be closely attached and fixed therein. The sensor case 151 may include a sensor flow path 152 in which the sensor connection port 150 is formed. The sensor connection port 150 may be arranged toward the air current separation surface 120 to be described later. The sensor connection port 150 may be arranged adjacent to the air current separation surface 120. The sensor connection port 150 will be described in detail later.

The air conditioner 1 may include the plurality of guide flow paths 110 formed to guide air to the inlet 12 of the main body 10. The plurality of guide flow paths 110 may be formed on the inlet panel 100. The plurality of guide flow paths 110 may be formed on the guide flange 103.

The air current separation surface 120 may be arranged between the plurality of guide flow paths 110. A plurality of air current separation surfaces 120 may be formed on the inlet panel 100. The air current separation surface 120 may be formed on the guide flange 103. The air current separation surface 120 may be provided to form a part of the surface of the inlet panel 100. Particularly, the air current separation surface 120 may be provided to form a part of the surface of the guide flange 103.

The plurality of guide flow paths 110 may form a flow path separated from the main flow path formed by the guide grille 101 and the guide flange 103. The main flow path and the plurality of guide flow paths 110 may be finally connected to the inlet 12 of the main body 10. The guide flow path 110 may be directly connected to the inlet 12. Alternatively, the guide flow path 110 may be connected to the main flow path and then connected to the inlet 12, together with the main flow path.

Referring to FIG. 4, the guide flow path 110 may be provided in a shape extending along the circumference of the guide flange 103. The guide flow path 110 may be provided in a band shape, having a predetermined length, along the circumference of the guide flange 103. The guide flow path 110 may be provided in a shape corresponding to a thickness of the guide flange 103. The guide flow path 110 may be provided in a shape that is long cut in the guide flange 103.

The guide flow path 110 may be provided in plurality. The air current separation surface 120 may be arranged between adjacent guide flow paths 110. Therefore, the air current separation surface 120 may also be provided in plurality. The air current separation surface 120 may be provided as a flat or curved surface arranged between adjacent guide flow paths 110.

Referring to FIG. 4, the plurality of guide flow paths 110 may be arranged side by side in a line along the circumference of the guide flange 103. For example, when four guide flow paths 110 are provided and arranged side by side in a line along the circumference of the guide flange 103, the air current separation surface 120 may also be formed at four positions C(C1), C(C2), C(C3), and C(C4) because the air current separation surface 120 is arranged between the guide flow paths 110 adjacent thereto. However, the position in which the air current separation surface 120 is formed is not limited thereto.

When the shape of the inlet 12 is provided in a polygonal shape including an edge E, the structure of the guide flange 103 and the air current separation surface 120 may be specified as follows.

The inlet 12 may be formed to correspond to one surface of the main body 10 provided in a polyhedral shape. That is, the shape of the inlet 12 may be provided in a polygonal shape including the edge E. The inlet panel 100 may be provided to correspond to the shape of the inlet 12, and thus the guide grille 101 and the guide flange 103 of the inlet panel 100 may also correspond to the shape of the inlet. Particularly, the guide flange 103 may correspond to an edge of one surface of the main body 10 to which the inlet 12 corresponds.

The plurality of guide flow paths 110 may be formed on the guide flange 103, and particularly, when the guide flange 103 is formed in a polygonal shape corresponding to the shape of the inlet 12, each of the plurality of guide flow paths 110 may be formed to correspond to each of the plurality of edges E. As described above, the guide flow path 110 may extend along the guide flange 103, that is, the edge E.

The air current separation surface 120 may be arranged between the guide flow paths 110 adjacent thereto. When each of the plurality of guide flow paths 110 is formed to correspond to each of the plurality of edges E, the air current separation surface 120 may be formed at a corner to which adjacent edges E among the plurality of edges E are connected.

Particularly, as described above, the main body 10 of the air conditioner 1 according to the present disclosure may be provided in a rectangular parallelepiped or a regular hexahedron, and the inlet 12 may correspond to the rear surface of the rectangular parallelepiped or the regular hexahedron. The shape of the guide flange 103 corresponding to the inlet 12 may also be provided in a rectangular annular shape.

As shown in FIG. 4, the guide flange 103 may include four edges E. Four guide flow paths 110 may be also provided and one guide flow path 110 may be formed for each edge E.

One air current separation surface 120 may be formed at each corner C(C1), C(C2), C(C3), and C(C4) to which the adjacent edges E among the plurality of edges E are connected.

Referring to FIG. 4, when the fan 510 operates and an air flow is formed inside the main body 10 through the inlet 12, the air outside the air conditioner 1 may be introduced from the rear side of the air conditioner 1 to the inside of the main body 10.

The air outside the air conditioner 1 may form a main air current S1 that is introduced from the front of the air conditioner 1 toward the guide grille 101 or that is introduced from a circumferential direction of the guide flange 103, that is, the up, down, and left and right side of the air conditioner 1, toward the guide flow path 110. The flow of air introduced through the guide grille 101 or the guide flow path 110 may be connected to the flow of air inside the main body 10 through the inlet 12.

Referring to FIGS. 6 to 8, the flow of air introduced from the circumferential direction of the guide flange 103 toward the guide flow path 110 may be formed toward the air current separation surface 120 of the guide flange 103. However, the air current separation surface 120 is arranged between the adjacent guide flow paths 110, and the main air current S1, which is a strong suction air current by the fan 510, is formed in the guide flow path 110. Therefore, most of the flow of air formed toward the air current separation surface 120 is diverged to the adjacent guide flow path 110. Accordingly, a sensing target region R, in which the influence of the main air current S1 is reduced, may be formed on the air current separation surface 120 of the guide flange 103.

The air conditioner 1 may include the sensor connection port 150 that is open toward the air current separation surface 120 in which the sensing target region R having a small influence of the main air current S1 is formed. The sensor connection port 150 may be arranged toward the air current separation surface 120. The sensor connection port 150 may be arranged adjacent to the air current separation surface 120. The air current separation surface 120 may be provided on one side of the upper end of the inlet 12. However, the formation direction of the air current separation surface 120 is not limited thereto, and may be formed at various positions as long as a position is toward the air current separation surface 120 in which the sensing target region R having a small influence of the main air current S1 is formed.

Referring to FIG. 7, a cross-sectional area of the guide flow path 110 formed on the inlet panel 100 may be greater than an area of the sensor connection port 150. Due to the air pressure difference with the air current separation surface 120 that is relatively higher than the air pressure of the sensor connection port 150, the sensing air current S2 from the air current separation surface 120 toward the sensor connection port 150 may be formed. The sensing air current S2 may flow to the sensor 140 by passing through the sensor connection port 150 and the sensor flow path 152.

The air current separation surface 120 may include a guide groove 121 concavely recessed at a position corresponding to the sensor connection port 150. The flow of air introduced through the guide groove 121 may more easily pass through the sensor connection port 150 and be transferred to the sensor 140.

Figure 9:
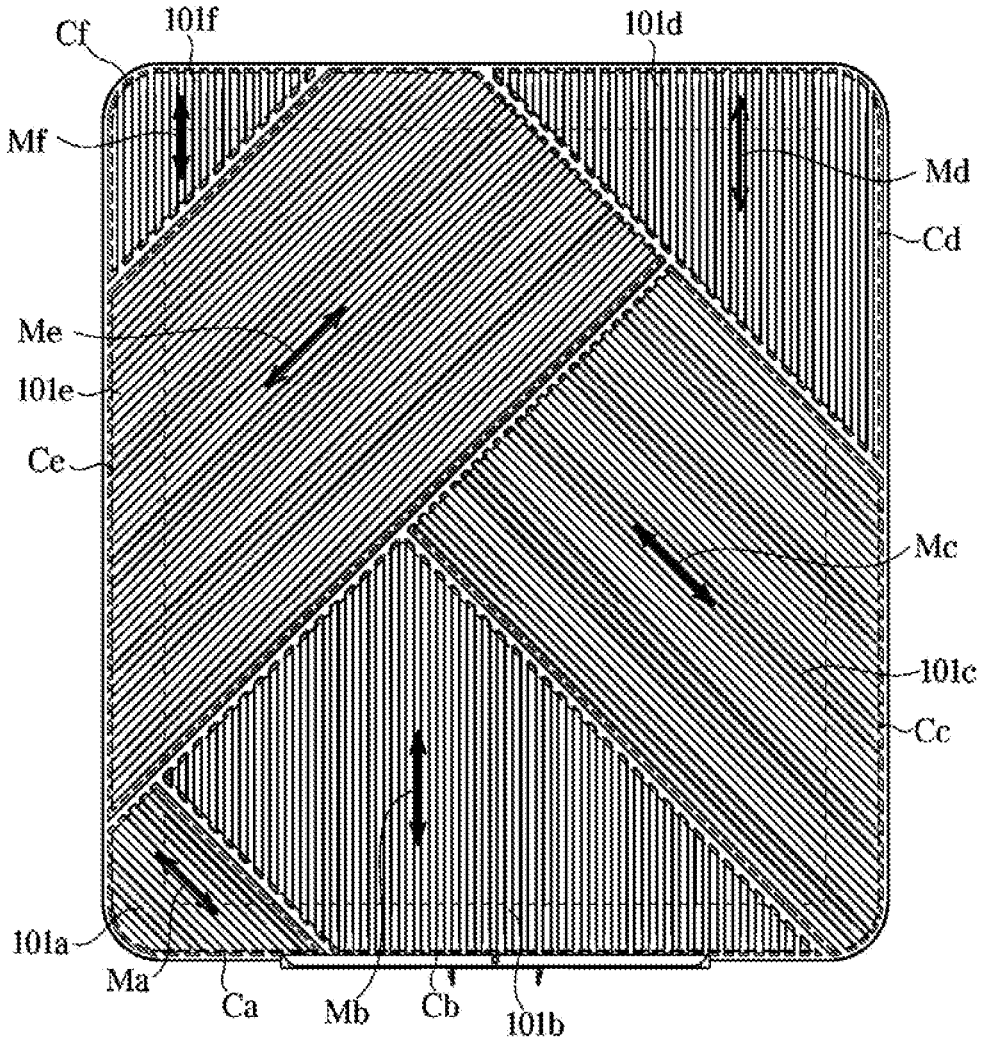
FIG. 9 is a view illustrating a guide grille of the air conditioner according to one embodiment of the present disclosure.

FIG. 9 is a view illustrating a guide grille of the air conditioner according to one embodiment of the present disclosure. Hereinafter a detailed structure of the guide grille 101 will be described.

The guide grille 101 may include a plurality of thin blades 101*a*, 101*b*, 101*c*, 101*d*, 101*e*, and 101*f*. The plurality of thin blades 101*a*, 101*b*, 101*c*, 101*d*, 101*e*, and 101*f* may be repeatedly arranged at regular intervals to form a part of the guide grille 101. A gap between the plurality of thin blades may form a micro suction port 102.

A plurality of thin blades forming a cluster to form a part of the guide grille 101 may be defined as a blade group Ca, Cb, Cc, Cd, Ce, and Cf. The guide grille 101 may be formed by gathering the plurality of blade groups Ca, Cb, Cc, Cd, Ce, and Cf. By gathering the plurality of blade groups, the guide grille 101 may be provided in a shape corresponding to the inlet 12.

As for the guide grille 101 shown in FIG. 8, six blade groups are gathered to form the guide grille 101, but it is not limited thereto. However, the guide grille may be formed by six or less or more blade groups and thus the guide grille may have a shape in accordance with the shape of the inlet 12.

Among the plurality of blade groups Ca, Cb, Cc, Cd, Ce, and Cf, the plurality of thin blades 101*a*, 101*b*, 101*c*, 101*d*, 101*e*, and 101*f* may extend in different directions. Referring to FIG. 8, a plurality of thin blades 101*a* of a first blade group Ca may be formed in a first direction Ma, a plurality of thin blades 101*b* of a second blade group Cb may be formed in a second direction Mb, a plurality of thin blades 101*c* of a third blade group Cc may be formed in a third direction Mc, a plurality of thin blades 101*d* of a fourth blade group Cd may be formed in a fourth direction Md, a plurality of thin blades 10*l* of a fifth blade group Ce may be formed in a fifth direction Me, and a plurality of thin blades 101*f* of a sixth blade group Cf may be formed in a sixth direction Mf.

The first direction MI to the sixth direction M6 may be formed in different directions. Further, as shown in FIG. 8, an extension direction of the plurality of thin blades of some of the plurality of blade groups Ca, Cb, Cc, Cd, Ce, and Cf may be formed in parallel to each other. The extension direction of the plurality of thin blades of the blade group of the guide grille 101 is not limited to the shape shown in FIG. 8.

Due to this structure, when a user looks at the inlet panel 100 from the outside of the air conditioner 1, a predetermined pattern may be formed. The guide grille 101 may allow the inlet 12 to communicate with the outside of the main body 10, and may improve the aesthetics of the air conditioner 1.

The guide grille 101 may primarily filter out large foreign substances contained in the air, which flows into the inlet 12, so as to prevent the filter unit 400 arranged inside the main body 10 from being blocked or damaged by the large foreign substances. In addition, the guide grille 101 may be provided to allow an air current, which is introduced into the inlet 12 through the plurality of blades, to form a vortex right after the air current passes through the guide grille 101. Particularly, because the extension directions of the plurality of thin blades of the plurality of blade groups are formed in different directions, the above-described vortex may be formed more easily. The air current mixed by the vortex may evenly pass through the front surface of the filter unit 400. The air current separation surface 120, to which the sensor connection port 150 is directed, may maintain a state in which the influence of the main air current S1 is reduced by the guide flow path 110 arranged therearound. Accordingly, the sensing air current S2 may be stably formed. Therefore, the air conditioner 1 may measure the level of contamination of the space to be purified without being affected by the internal and external main air current and installation environment.

While the present disclosure has been particularly described with reference to exemplary embodiments, it should be understood by those of skilled in the art that various changes in form and details may be made without departing from the spirit and scope of the present disclosure.

What is claimed is:

1. An air conditioner, comprising:

a main body including an inlet;

a plurality of guide flow paths to guide air from outside of the main body to the inlet of the main body;

a fan to guide the air guided by the plurality of guide flow paths and introduced to inside of the main body through the inlet;

an air current separation surface including a recess forming a guide groove, the air current separation surface arranged between adjacent guide flow paths among the plurality of guide flow paths, to allow the air from outside of the main body to be separated and flow to the plurality of guide flow paths;

a sensor to sense a level of contamination in an indoor space; and a sensor connection port arranged adjacent to and facing the air current separation surface so that while the sensor is connected to the sensor connection port, an air current to be sensed flows along the guide groove and through the sensor connection port to the sensor as the air separated by the air current separation surface flows toward the plurality of guide flow paths.

2. The air conditioner of claim 1, further comprising:

an inlet panel to form an exterior of the main body and to cover the inlet, the inlet panel to allow the air from the outside of the main body to flow toward the inlet, wherein the plurality of guide flow paths and the air current separation surface are formed on the inlet panel.

3. The air conditioner of claim 2, wherein the inlet panel includes:

a guide grille to cover the inlet; and a guide flange formed along a circumference of the guide grille and couplable to the main body, wherein the plurality of guide flow paths and the air current separation surface are formed on the guide flange.

4. The air conditioner of claim 3, wherein the plurality of guide flow paths are in a shape that extends along a circumference of the guide flange.

5. The air conditioner of claim 3, wherein the air current separation surface is provided to form a part of a surface of the inlet panel.

6. The air conditioner of claim 3, wherein the air current separation surface is among a plurality of air current separation surfaces, wherein the sensor connection port and the sensor that is connectable to the sensor connection port are provided to correspond to at least one air current separation surface of the plurality of air current separation surfaces.

7. The air conditioner of claim 3, wherein the guide flange is provided in such a way that a cross section formed by the circumference of the guide flange becomes smaller from the guide grille toward the main body.

8. The air conditioner of claim 1, wherein the air current separation surface is formed as a convex curved surface.

9. The air conditioner of claim 1, wherein the guide groove is concavely recessed at a position corresponding to the sensor connection port.

10. The air conditioner of claim 3, wherein the main body is formed as a polyhedron, wherein the inlet corresponds to one surface of the main body, wherein the guide flange corresponds to an edge of the one surface to which the inlet corresponds.

11. The air conditioner of claim 10, wherein the edge is among a plurality of edges, wherein each of the plurality of guide flow paths is formed to correspond to each of the plurality of edges, wherein the air current separation surface corresponds to a corner to which adjacent edges among the plurality of edges are connected.

12. The air conditioner of claim 2, wherein a cross-sectional area of the plurality of guide flow paths is formed on the inlet panel is greater than an area of the sensor connection port.

13. The air conditioner of claim 1, wherein the air current separation surface is provided on one side of an upper end of the inlet.

14. The air conditioner of claim 1, further comprising:

a sensor case arranged inside the main body to accommodate the sensor, wherein the sensor case incudes a sensor flow path in which the sensor connection port is formed.

15. The air conditioner of claim 7, further comprising:

a guard flange arranged between the inlet panel and the main body, and spaced from an outer circumference of the guide flange, the guard flange formed in a shape corresponding to the guide flange to fix the inlet panel and the main body to each other, wherein the guard flange includes an auxiliary flow path provided in a shape corresponding to the sensor connection port and arranged at a position corresponding to the sensor connection port.

* * * * *